US007415788B2

(12) United States Patent
Little et al.

(10) Patent No.: US 7,415,788 B2
(45) Date of Patent: Aug. 26, 2008

(54) SOUVENIR TOOTHBRUSH, HOLDER AND SOAP DISH

(75) Inventors: Gary Little, West Dundee, IL (US); Vladimir Gekhter, Skokie, IL (US)

(73) Assignee: Pearl-Tek, Inc., West Dundee, IL (US)

( * ) Notice: Subject to any disclaimer, the term of this patent is extended or adjusted under 35 U.S.C. 154(b) by 53 days.

(21) Appl. No.: 11/404,740

(22) Filed: Apr. 13, 2006

(65) Prior Publication Data

US 2006/0230652 A1 Oct. 19, 2006

Related U.S. Application Data

(60) Provisional application No. 60/670,819, filed on Apr. 13, 2005.

(51) Int. Cl.
*G09F 3/00* (2006.01)

(52) U.S. Cl. ..... 40/314; 40/913; 40/661; 15/143.1

(58) Field of Classification Search ..... 40/586, 40/661, 314, 661.12, 618, 913; 15/167.1, 15/143.1

See application file for complete search history.

(56) References Cited

U.S. PATENT DOCUMENTS

| | | | | | |
|---|---|---|---|---|---|
| 876,317 | A | | 1/1908 | Booth | |
| 1,155,878 | A | | 10/1915 | Booth | |
| 1,211,468 | A | | 1/1917 | McLean | |
| 1,364,188 | A | | 1/1921 | Draenert | |
| 1,815,154 | A | | 7/1931 | Larson | |
| 2,016,644 | A | | 10/1935 | Luball | |
| 2,138,993 | A | * | 12/1938 | Bangs | 40/314 |
| 2,187,192 | A | * | 1/1940 | Albrecht | 40/661 |
| 2,317,123 | A | | 4/1943 | Warp | |
| 2,548,151 | A | | 4/1951 | Friedman | |
| 4,177,587 | A | | 12/1979 | Dorsen et al. | |
| 4,589,159 | A | * | 5/1986 | Streibel | 15/167.1 |
| 5,054,154 | A | * | 10/1991 | Schiffer et al. | 15/167.1 |
| 5,487,203 | A | | 1/1996 | Brach, Jr. et al. | |
| 5,781,958 | A | | 7/1998 | Meessmann et al. | |
| 5,934,295 | A | | 8/1999 | Gekhter et al. | |
| 6,298,516 | B1 | | 10/2001 | Beals et al. | |

(Continued)

*Primary Examiner*—Lesley D. Morris
*Assistant Examiner*—Christopher E Veraa
(74) *Attorney, Agent, or Firm*—Schiff Hardin LLP

(57) ABSTRACT

A souvenir toothbrush includes a head part of the toothbrush with bristles, a handle part made with clear or opaque thermoplastic material, a molded recess inside the handle for placement of an insert having text or an image on one or both sides, a clear or opaque window insert placed inside the recess on top of the insert and a soft spongy part of the toothbrush molded to the handle of the toothbrush for convenient gripping of the handle by a user. The insert has ribs around the perimeter to allow it to be centered within the pocket of the handle and leave a gap between the insert and the pocket to be filled with soft thermoplastic elastomer. The insert is also designed with a step on either side to allow more efficient manipulation of the insert during manufacturing. A toothbrush holder, soap dish and other toiletry articles can also have a similar insert design. The toothbrush holder is designed to keep the toothbrushes, or other implements stored in the holder, from touching the bristles of other toothbrushes in the holder and is constructed for easy cleaning to avoid the accumulation of germs.

38 Claims, 13 Drawing Sheets

U.S. PATENT DOCUMENTS 6,400,247 B1 * 6/2002 King ..... 335/302
D480,214 S 10/2003 Kling et al.
D485,989 S 2/2004 Winkler et al.
6,687,940 B1 2/2004 Gross et al.
2004/0139569 A1 7/2004 Chen
2005/0044646 A1 3/2005 Peretz et al.
2005/0109364 A1 5/2005 Gross et al.
2006/0118130 A1 * 6/2006 Little et al. ..... 132/147

* cited by examiner

SOUVENIR TOOTHBRUSH, HOLDER AND SOAP DISH

CROSS REFERENCE TO RELATED APPLICATIONS

This application claims the benefit of U.S. Provisional Patent Application Ser. No. 60/670,819, filed Apr. 13, 2005, which is incorporated herein by reference.

The subject matter of the present invention is related to the subject matter of U.S. patent application Ser. No. 11/002,020.

BACKGROUND OF THE INVENTION

1. Field of the Invention

The present invention relates to toothbrushes, toothbrush holders, and soap dishes and in particular to a toothbrush, toothbrush holder and soap dish each having an imbedded image and/or message.

2. Description of the Related Art

Personal care articles such as toothbrushes often have logos, messages, pictures, and the like on or in the handle or other portion of the toothbrush. Existing methods of providing such logos, messages, pictures, and the like on or in the article handles includes the use of decals, ink imprinting, laser imprinting, and labels applications. For toothbrushes, since toothpaste is an aggressive and abrasive substance, it is common that after using the toothbrush several times, the logos, messages, pictures, and the like wear or come off partially or entirely. It is desirable to provide the logos, messages, and pictures so that it will remain on the toothbrush despite heavy use around abrasive substances.

Toothbrushes are regularly held in toothbrush holders and used near soap dishes. Coordinated sets of toothbrush holders and soap dishes are commonly available. Although a toothbrush holder and soap dish may not be as frequently surrounded by or used in conjunction with abrasive substances such as toothpaste, it can still produce similar wear of any decorations applied to the articles.

Toothbrush holders present additional problems in that they can be difficult to clean, allowing for the accumulation of germs. Toothbrush holders are often made in one configuration, allowing limited flexibility in the number of toothbrushes that can be contained within the holder and not necessarily preventing the toothbrush heads from contacting one another.

SUMMARY OF THE INVENTION

The present invention, in some embodiments, provides a toothbrush with one or more images and/or text imbedded in a handle. Other embodiments provide a toothbrush holder either alone or in combination with a toothbrush, where the toothbrush holder has one or more images and/or text imbedded in a portion thereof. Another embodiment of the invention provides a soap dish either alone or in combination with a toothbrush and/or toothbrush holder, where the soap dish has one or more images and/or text imbedded in a portion thereof.

Each toothbrush has one or more images and/or text embedded in the toothbrush handle, in some embodiments the images and/or text are magnified by the handle design and optical characteristics of the handle's material. Brightly colored and high definition pictures are integrated into the toothbrush design in an ergonomic and artistic matter such that they significantly increase the appeal of the products. The toothbrush may have images integrated into a clear handle or may have an opaque handle with a clear window insert integrated into the opaque handle.

Advantageously, the image and/or text, which may be a multi-colored image and/or text, stays inside of the handle and does not come into contact with aggressive toothpaste or skin oils, thereby retaining its original quality for the duration of the product's usage. Various embodiments of the invention include those having an interchangeable insert of different colors with different messages molded on the top of the insert. Other toiletry articles or personal care products may use the principles of the present invention to provide similar inserts with one or more images and/or text in the handle or body of such articles. This may be used to deliver a message to the users, improve mood in the morning with images such as cats, dogs or pictures of favorite places such as parks, buildings, mountings, rivers, sports and games and so on and decorate the bathroom with high quality colorful products. They can also be used for advertisement purposes.

The toothbrush holder with one or more similar inserts with one or more images and/or text has a structure that prevents accumulation of germs inside the toothbrush holder. The toothbrush holder may be provided with and coordinate with a toothbrush as described above. The toothbrush holder has a design that allow users to clean it easily. The toothbrush holder can be configured to accommodate different numbers of toothbrushes by changing a few components. In some embodiments, the toothbrush holder can hold one or three toothbrushes, but the invention is not limited to those embodiments. In some embodiments, the toothbrush holder is provided disassembled or can be disassembled for compact storage and/or shipment.

Toothbrushes and toothbrush holders constructed with different types of thermoplastic materials and different color combinations. Combinations of different materials of different colors with colored bristles and multicolor integrated images create a variety of different product ensembles. The soap dish preferably has one or more similar inserts with one or more images and/or text and may be coordinated with the toothbrush and/or toothbrush holder. Similar considerations of construction, colors and materials apply to the soap dish.

BRIEF DESCRIPTION OF THE DRAWINGS

FIG. 10 A is an exploded view of another embodiment of the handle and insert.

FIG. 10 B is an exploded view of a portion of the toothbrush handle of yet another embodiment of the clear window insert and handle.

DETAILED DESCRIPTION OF THE INVENTION

Figure 1:
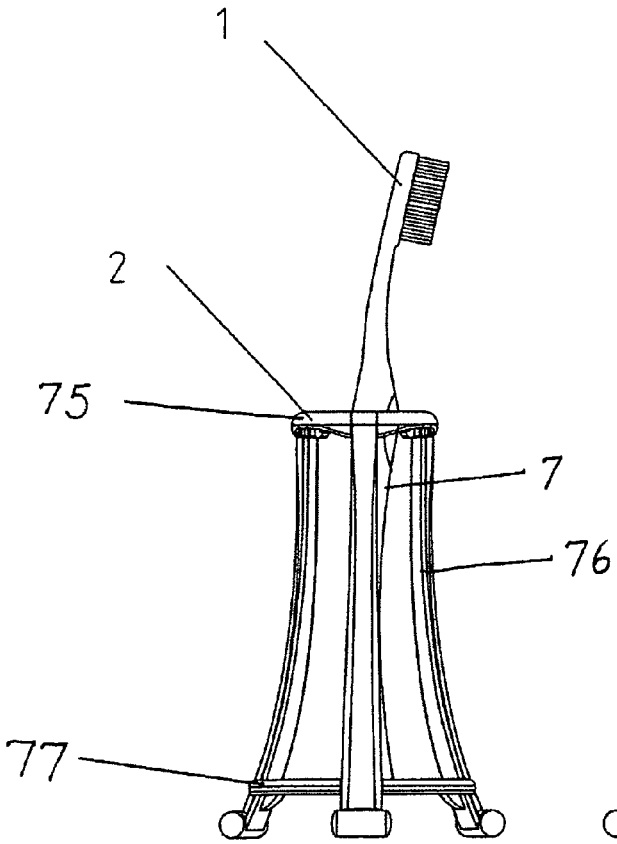
FIG. 1 is a side view of the present toothbrush in the toothbrush holder configured to hold one toothbrush, according to the principles of the present invention.

Referring to FIG. 1, one embodiment of the toothbrush 1 is shown inserted into one embodiment of the toothbrush holder 2. The toothbrush holder 2 is shown assembled in FIG. 1, but the construction is such that the toothbrush holder 2 may be packaged flat and assembled by the user. The toothbrush holder 2 is composed of a support ring 75, legs, 76, and a support base, 77. These components are assembled into a toothbrush holder 2 suitable for supporting a toothbrush 1 in an upright position and preventing the bristles on the toothbrush 1 from contacting other surfaces in the bathroom, but also can be disassembled for thorough cleaning of the toothbrush holder 2 to prevent accumulation of germs. The structure, with the independent legs 76, support base 77, and support ring 75, provides not only easy assembly and disassembly for cleaning purposes, but can save shipping costs and can be stored easily because of the flat packaging.

The toothbrush 1 and toothbrush holder 2 also have visual appeal in that both the toothbrush 1 and toothbrush holder 2 can be manufactured in a variety of colors. The pieces used to construct the toothbrush holder 2 can be the same or different colors, depending upon the desired aesthetic effect. The toothbrush 1 may be coordinated with the toothbrush holder 2 to match any or all of the colors of the parts of the toothbrush holder 2. Further, the toothbrush 1 and toothbrush holder 2 both can be used to display a logo, picture, image or other type of visual display. Colored inserts with high definition text or graphics can be placed in the toothbrush handle 7 and toothbrush holder support base 77. This provides the opportunity for the user to further coordinate their bathroom decor, for an advertiser to promote a product or service with both the toothbrush 1 and toothbrush holder 2, or for any other purpose where a visual display in a toothbrush 1 and/or toothbrush holder 2 is desirable.

Figure 2:
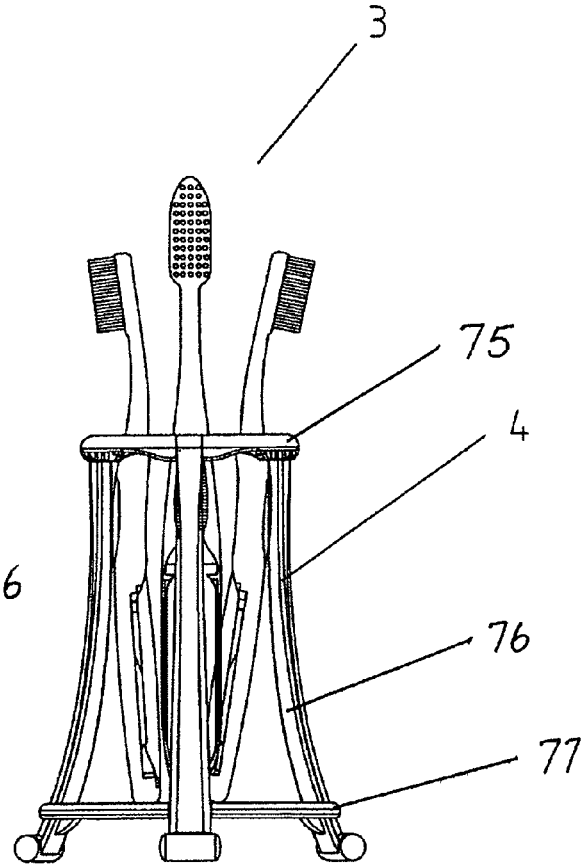
FIG. 2 is a side view of the present toothbrushes in a toothbrush holder configured for holding three toothbrushes.

FIG. 2 illustrates another embodiment of the toothbrush holder 4, where three toothbrushes 3 may be inserted into the toothbrush holder 4 at one time. The toothbrush holder 4 is composed of the same basic parts that are displayed in FIG. 1: a support ring 75, legs 76, and a support base 77. Where the support ring 75 and support base 77 in FIG. 1 were configured to accommodate only one toothbrush 1, the support ring 75 and support base 77 in FIG. 2 are configured to accommodate three toothbrushes 3. The toothbrush holder 4 can be configured to hold different numbers of toothbrushes 3 or other personal care and/or toiletry items, such as a flosser, toothpaste, a shaver, a brush or a comb. The independent components 75, 76, and 77 of the toothbrush holder 4 combine practical qualities with aesthetic qualities. Different combinations of materials and/or colors, along with the images that can be integrated into both the toothbrushes 3 and the toothbrush holder 4, can create many different looks.

When a toothbrush holder 4 is configured to accommodate more than one toothbrush 3 or other personal care and/or toiletry article, it provides for additional assistance in preventing the accumulation of germs. Not only does the toothbrush holder 4 come apart for easy and thorough cleaning, the toothbrush holder 4 is designed in such a way that after placement of the toothbrushes 3 into the holder 4 the heads of the toothbrushes 3 are inclined in a opposite directions from each other and are prevent from touching other toothbrushes 3 in the holder 4. The toothbrush holder 4 can be kept clean to prevent the toothbrushes 3 from contacting surfaces that have not been cleaned and the toothbrush holder 4 prevents germs from being passed from toothbrush 3 to toothbrush 3 through contact of the head portion of the toothbrush 3 which is used to clean teeth.

Figure 3:
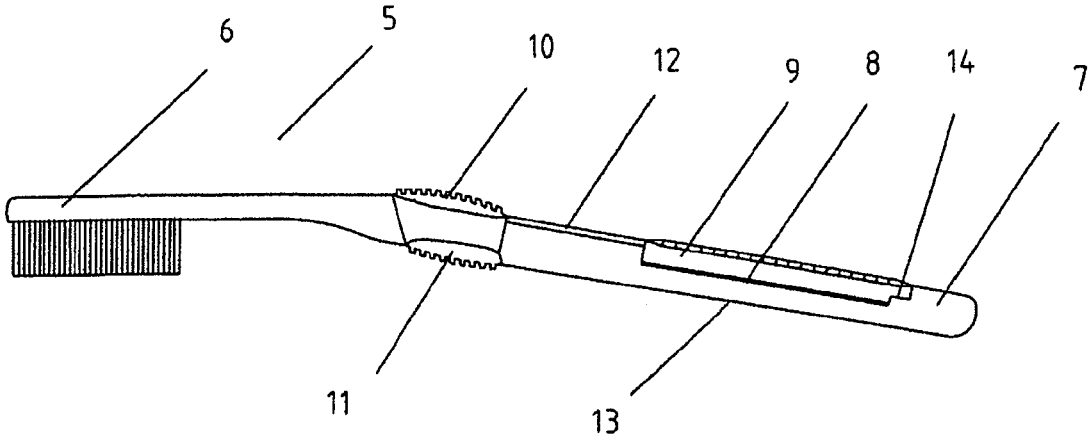
FIG. 3 is a longitudinal section view through the present toothbrush showing a configuration with a clear handle, a logo insert, and a picture insert.

A pocket or recess for image and/or text insert and/or logo insert is located on the handle on the side opposite from the bristles and picture image can be visible from the bristle side. One detailed embodiment of the toothbrush 5 illustrated in the figures is shown in a longitudinal section view in FIG. 3. The toothbrush 5 in this embodiment has a toothbrush head 6 containing bristles 6A and a clear handle 7 which is held by the user when brushing his or her teeth. The clear handle 7 may instead be composed of an opaque material. The toothbrush 5 also has a image and/or text insert 8 that may be locked into the recess 14 in the handle 7 by either an opaque or clear insert 9.

The components of the present toothbrush, toothbrush holder, and soap dish are preferably formed by molding, using an injection molding process. A two step process is preferred with the body of the article being formed in the first step and additional features being formed in a second injection molding step. A soft finger support 10 and thumb grip 11 are molded onto the handle 7, for example, by the second shot or step of the injection molding process, and provide a comfortable grip on the handle 7 for the user of the toothbrush 5. Soft thermoplastic elastomer material passes through the bridge 12 to the fingers support 11, providing additional comfort for the user. The image used in the picture insert 8 is visible through the bristle side of the clear handle 13 from the bristle side of the toothbrush 5.

Figure 4:
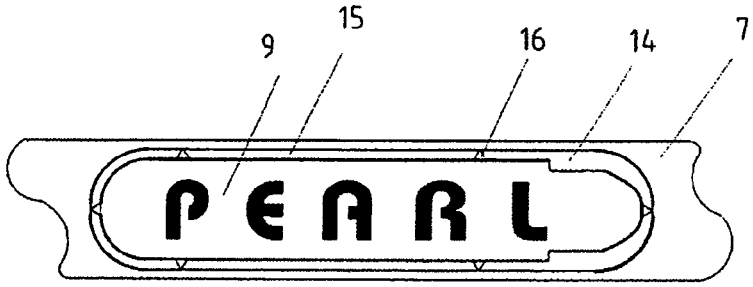
FIG. 4 is a top view of the logo insert of FIG. 3 placed inside a pocket of the toothbrush handle.

The logo insert 9 is shaped to allow for easier insertion into the recess 14 in the handle 7 and for correct placement of the insert 9 in the recess 14. The logo insert 9 is placed into the recess 14 of the toothbrush's 5 handle 7. As illustrated in FIG. 4, the insert 9 is smaller than the recess 14, creating a gap 15 between the walls of the toothbrush handle 7 and insert 9 after placement of insert 9 inside the recess 14.

Different physical features can be used to ensure that the insert 9 is placed correctly within the recess 14 on the toothbrush handle 7. In the embodiment shown in FIGS. 4 and 5, small ribs 16 are placed at points around the perimeter of the insert 9. The ribs 16 of one embodiment take the form of a pyramid and help to stabilize and center the insert 9 in the recess 14 while leaving a gap 15 between the insert 9 and the recess 14 walls. The ribs 16 are of a height to fit into the gap 15 between the insert 9 and the recess 14 walls, while leaving most of the gap 15 open.

In this embodiment, the gap 15 between the insert 9 and the toothbrush handle 7 is filled with the soft thermoplastic elastomer material, for example, during the second shot or step, which applies the soft thermoplastic elastomer, of the two step molding process. This provides additional stability for the logo insert 9. The tips of the pyramid-shaped ribs 16 located along the perimeter of the insert 9 are barely, or not at all, visible from the side of the brush after the gap 15 is filled with soft thermoplastic elastomer.

Figure 5:
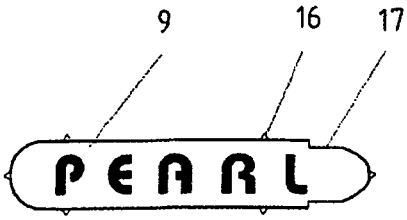
FIG. 5 is a top view of the logo insert of FIG. 4.
Figure 6:
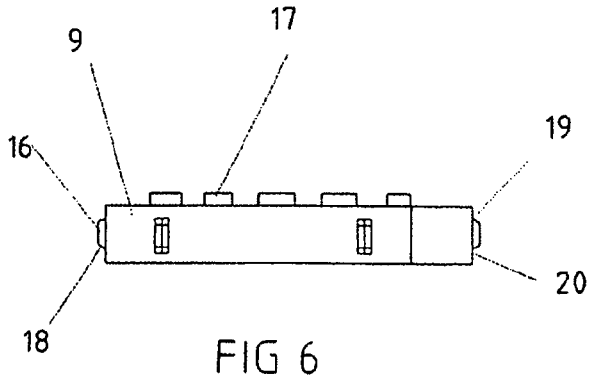
FIG. 6 is a side view of the logo insert of FIG. 4.

Additional features that provide improved handling and placement of the insert 9 in the recess 14 of the toothbrush handle 7 are steps 17 that are illustrated in FIGS. 5 and 6. This embodiment of the invention has two symmetrical steps 17 along the longitudinal axis of the insert 9. These steps 17 are formed in the insert 9 in order to provide orientation and positioning of the inserts 9 during automatic assembly process and serve as gripping areas for the automatic loading of the inserts 9 inside the toothbrush recess 14. Other features may be incorporated to permit the inserts 9 to be automatically placed into the recess 14 in a correct placement in the recess 14 so that automatic assembly of portions of the toothbrush can make manufacture of the product easier and less costly.

In FIG. 6, the ribs 16 are shown in greater detail. The ribs 16 are located in the middle of the insert 9 with respect to the insert's 9 height. The spaces 19 and 20 above and below the ribs 16 allow for the soft thermoplastic elastomer or other material used to fill the gap between the insert 9 and the recess 14 in the handle 7 to completely surround the ribs 16, making the ribs 16 barely, or not at all, visible on the finished product. The ribs 16 have leading chamfers 18 to facilitate positioning of the inserts 9 inside the toothbrush recesses 14 during assembly. This detail of the rib 16 structure accommodates for tolerances in automatic machine manufacturing and in robotic transfers. Other embodiments that provide the same combination of ease of machine manufacture and an attractive finished product may be used in place of the ribs 16.

When the toothbrush is assembled, the image on the insert is preserved under a clear window insert. This allows for the image to be protected from wear and to be clearly visible whether the toothbrush handle is formed of opaque or clear material. While the recess for the insert is shown in the handle of the toothbrush below the area where a special grip is provided, however, the recess can be provided at any location on the handle where a recess can be formed. In the embodiment pictured in FIG. 7, the recess is located on the handle 27 on the same side of the toothbrush 25 as the bristles.

Figure 7:
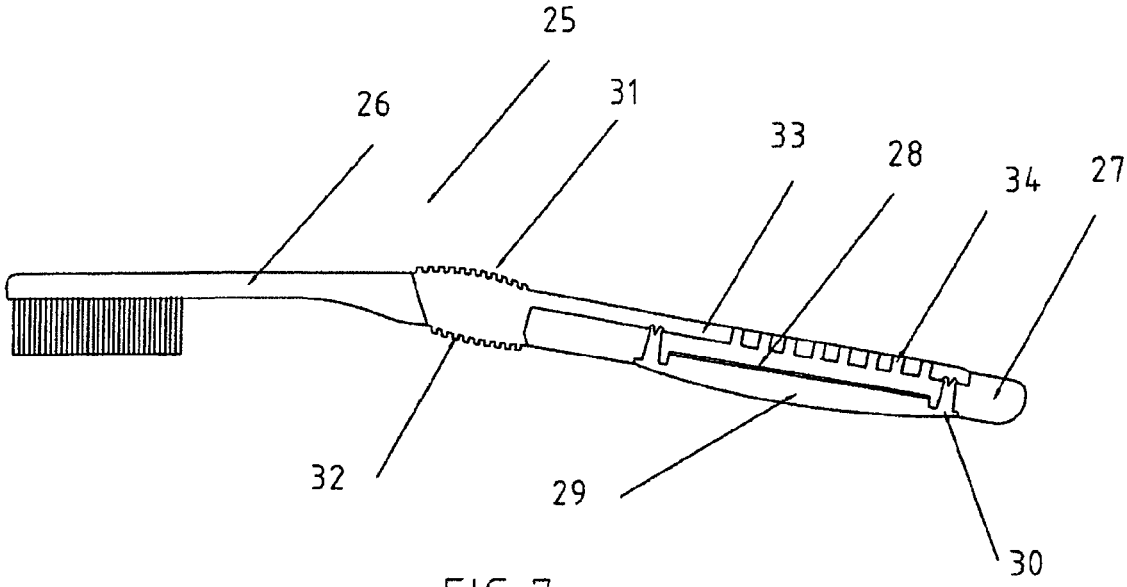
FIG. 7 is a longitudinal section view through an embodiment of the present toothbrush showing a configuration with an opaque handle, a clear window insert, and a picture insert.

The present toothbrushes are provided with different configurations, depending upon whether the material of which they are formed is transparent or opaque. The different configurations capitalize on the characteristics of the material being used. For example, FIG. 7 is a longitudinal section view through the toothbrush 25 configured with an opaque handle. The toothbrush 25 is comprised of toothbrush head 26, opaque handle 27, picture insert 28 (which is locked into the recess by clear window insert 29). When the device is formed using a two step molding process, the soft finger support 31 and thumb grip 32 are molded on to the handle 27 by the second shot injection molding step. Soft thermoplastic elastomer material extends through the bridge 33. The image of the picture insert 28 is visible through the clear window insert 29 from the bristle 6A side of the toothbrush 25. The clear window insert 29 is secured to the toothbrush handle 27 by collapsible fingers 30 that can be compressed for insertion into the toothbrush handle 27 and expand after insertion to lock the clear window insert 29 and picture insert 28 into place. Logos, text or images, 34 are placed on the side opposite the toothbrush bristles 6A and are a part of the toothbrush handle 27.

The embodiment in FIG. 7 has the bridge 33 located on the opposite side from the bristles 6A. Alternatively, the bridge 45 can be placed on the same side of the handle 40 as the toothbrush bristles 6A. In this embodiment, illustrated in FIG. 8, the logo 44 is placed on the same side of the toothbrush as the bridge 45 and is a part of the toothbrush handle 40. The visual display on the insert 41 faces the side of the toothbrush opposite the bristles 6A and is located in the handle. This embodiment is similar to the one shown in FIG. 7, but the different placement of the logo and insert in the two figures is illustrative of the flexibility with which the concepts of the invention may be employed and the different aesthetic effects that can be achieved.

Figure 9:
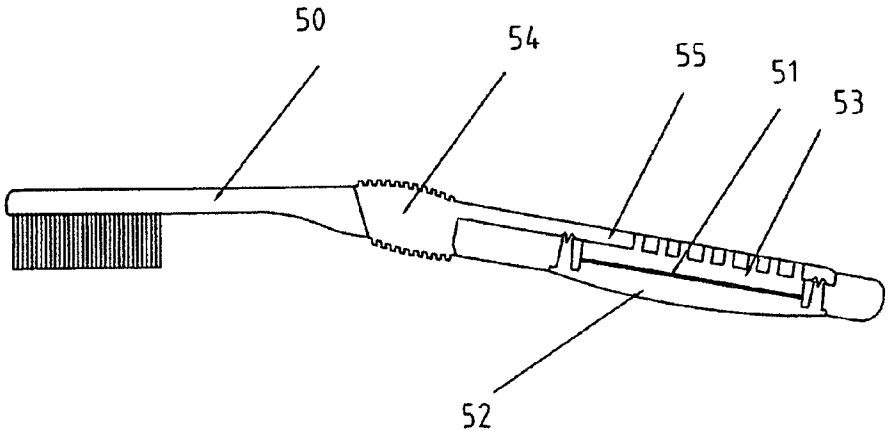
FIG. 9 is a longitudinal section view through yet another embodiment of the present toothbrush showing a configuration with an opaque handle, a clear window insert, a picture insert and a logo insert.

FIG. 9 illustrates another embodiment of the toothbrush which is constructed to take advantage of an opaque handle 50, picture insert 51, clear window insert 52, interchangeable logo insert 53, soft fingers grip areas 54 and bridge 55. In this embodiment, the bridge 55 and logo insert 53 are placed on the side opposite the toothbrush bristles 6A and the picture image faces the same side as the bristles 6A. The same toothbrush design concept is available with the location of the clear window insert 52 and logo insert 53 reversed so that the picture image will face the side opposite the toothbrush bristles for additional flexibility in the visual appearance of the device. The insert may be interchanged for other inserts during the manufacture of the article so that a variety of inserts and/or logos result from a production run. It is also envisioned that the inserts may be able to be interchanged by the user.

Figure 8:
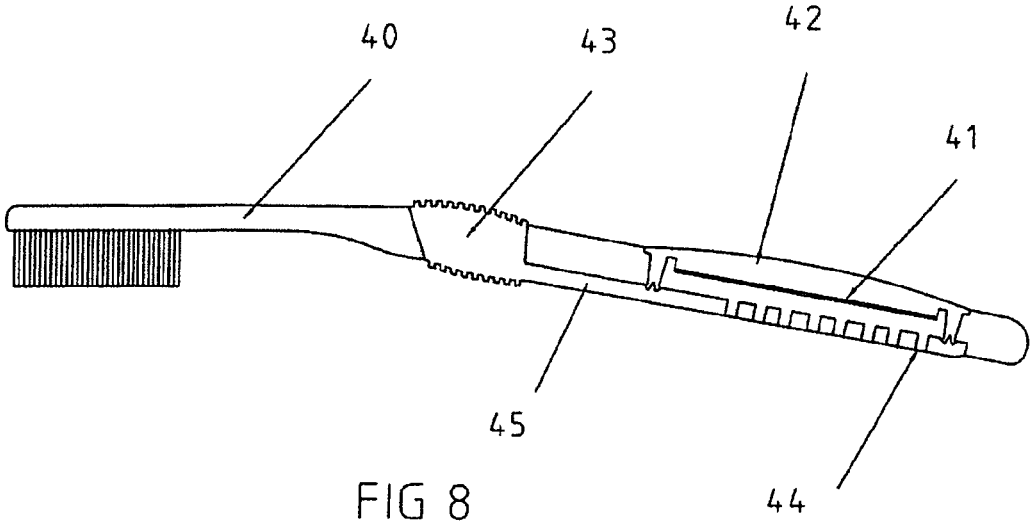
FIG. 8 is a longitudinal section view through a different embodiment of the present toothbrush showing a configuration with an opaque handle, a clear window insert, and a picture insert.
Figure 10:
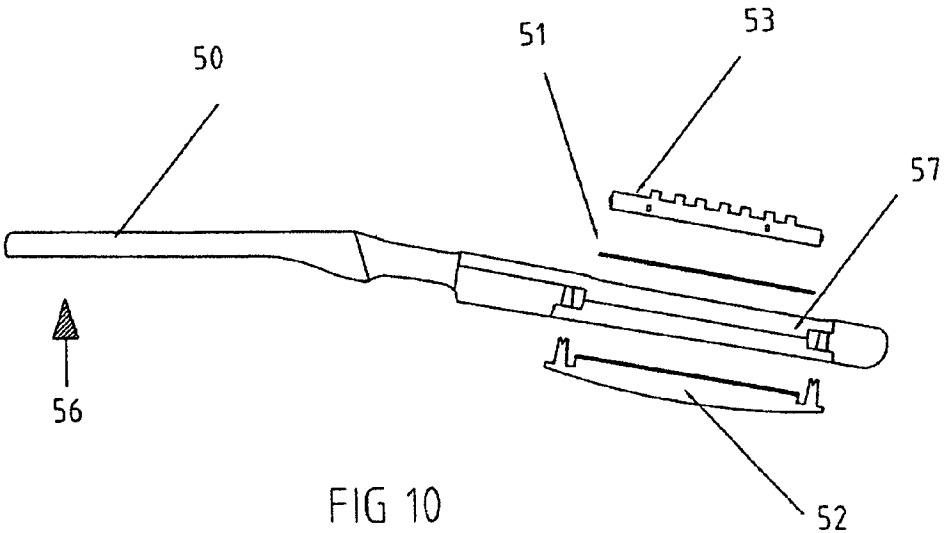
FIG. 10 shows an exploded view of the components and the sequence of the assembly of an opaque toothbrush handle with a clear window insert, an image insert and a logo insert.
Figure 10A:
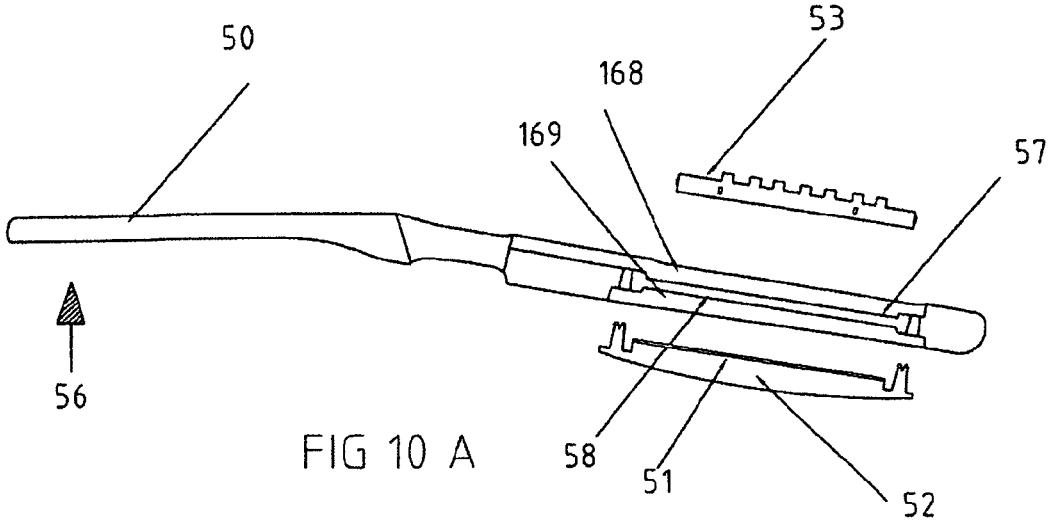

As illustrated by the different configurations of the invention in FIGS. 7, 8, and 9, the placement of the different parts that make up the device can vary. FIGS. 10 and 10A show the opaque toothbrush handle 50 with the components in an exploded view, illustrating in greater detail the assembly of the toothbrush in two of the different embodiments. Components can be assembled from either side of the handle 50. In one embodiment, the clear window insert 52 is inserted into the pocket 57 in the toothbrush handle 50 from the bristle side 56. The picture insert 51 is placed on the top of the clear window insert 52, facing the bristle side 56. The logo insert 53 is placed on top of the picture insert 51. After assembly, the handle 50 is molded with thermoplastic elastomer material which secures the assembly. FIG. 10A shows another embodiment of the handle design. Handle 50 has a wall 58 for improving the rigidity of the handle 50 over the handle 50 configuration with the open pocket as shown in FIG. 10. In this more rigid configuration, the handle 50 has two separate pockets, one pocket 168 for the logo insert 53 and one pocket 169 for the picture 51 and window insert 52.

Figure 10B:
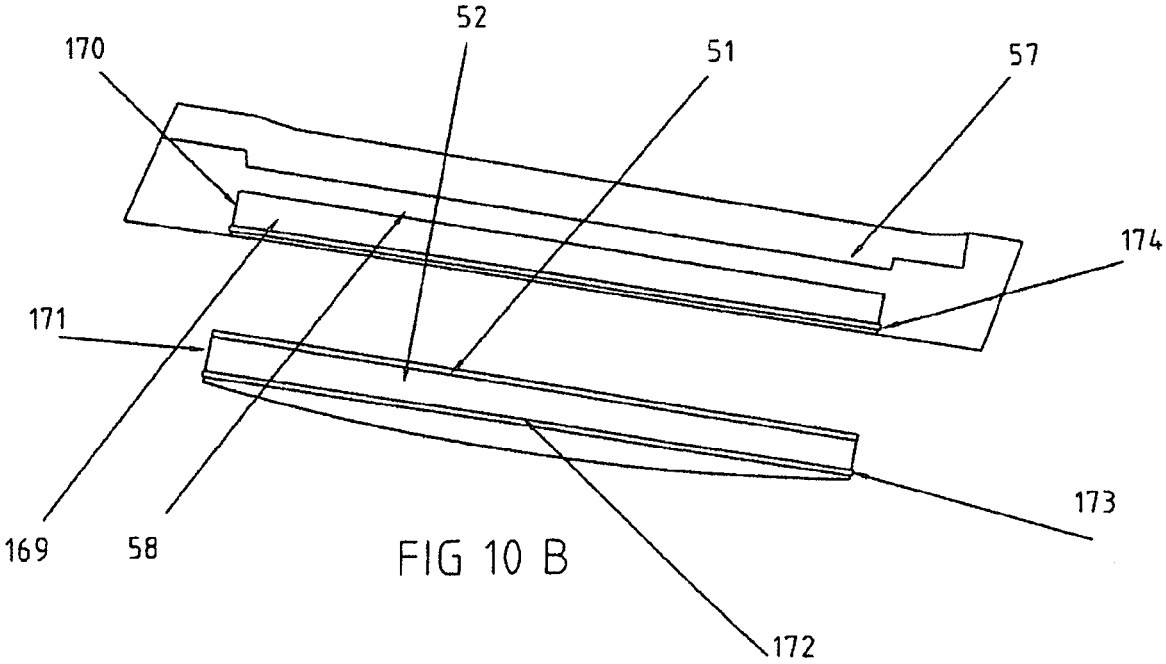

FIG. 10B is a detailed view of another embodiment of a clear window insert 52. The insert 52 has a straight wall 171 on the perimeter without latches. This design provides a better aesthetic appearance for the toothbrush because the clear window insert is the same size as a picture insert 51. The clear window insert 52 is retained in the toothbrush through friction between the walls 171 of the clear window insert 52 and the walls 170 of the pocket 169. Alternatively, a snap clamping of the insert 52 by a rib 173 around the perimeter of the insert and a corresponding undercut groove 174 in the window 169 of handle 50 may be provided. This embodiment is assembled by pressure fitting the insert 52 into the pocket 169.

Figure 11:
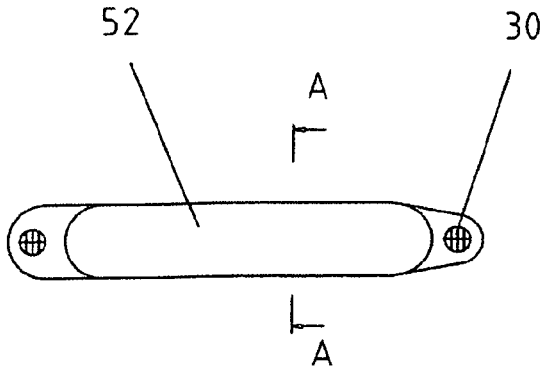
FIG. 11 is a top view of one embodiment of the clear window insert.
Figure 13:
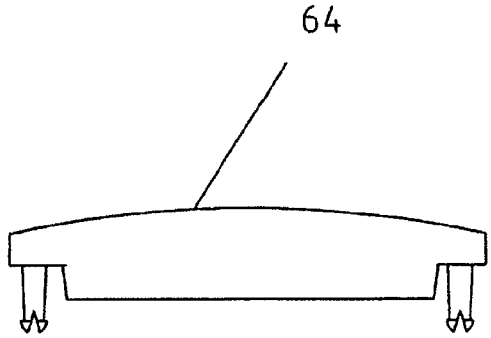
FIG. 13 is the side view of a variation of the clear window insert of FIG. 11 with a convex window.
Figure 12:
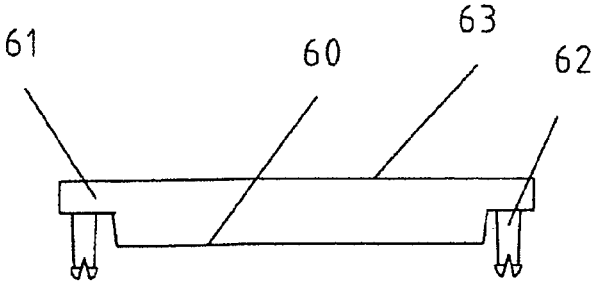
FIG. 12 is a side view of a variation of the clear window insert of FIG. 11 with a flat window.
Figure 14:
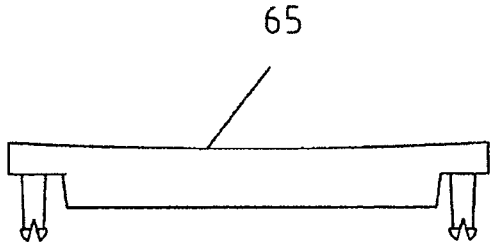
FIG. 14 is the side view of a variation of the clear window insert of FIG. 11 with a concave window.
Figure 15:
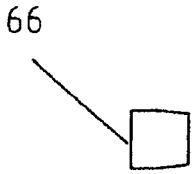
FIG. 15 is a cross-sectional view along line A-A of FIG. 11 showing the flat window embodiment of FIG. 12.
Figure 16:
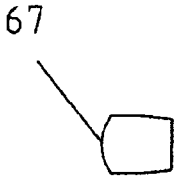
FIG. 16 is a cross-sectional view along line A-A of FIG. 11 showing the convex window embodiment of FIG. 13.
Figure 17:
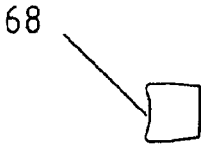
FIG. 17 is a cross-sectional view along line A-A of FIG. 11 showing the concave window embodiment of FIG. 14.

The clear window insert with locking fingers can take different forms. In FIG. 11, the top view of the clear window insert 52 illustrates possible positioning of the locking fingers 30. FIGS. 12, 13, and 14 show the clear window insert 61 with two locking fingers 62 and a picture contact surface 60. In FIG. 12, the clear window insert has a flat window 63. This embodiment is shown in cross section in FIG. 15. Another embodiment of the clear window insert has a convex shaped window 64. The convex embodiment is illustrated in side view in FIG. 13 and in cross section in FIG. 16. Another embodiment of the clear window insert has a concave shaped window 65. The convex embodiment is illustrated in side view in FIG. 14 and in cross section in FIG. 17.

Figure 18:
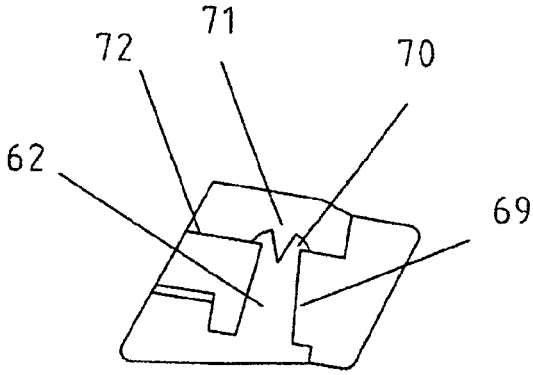
FIG. 18 is an enlarged view of the locking pins of the clear window insert.

FIG. 18 is an enlarged view of one arrangement of the locking fingers 62 of the clear window insert. Finger 62 has a head 70 with an outside diameter bigger then the opening of the handle where the pins should be inserted. The head 70 of the locking fingers 62 has a gap 71. The head 70 collapses under pressure during insertion into the respective opening in the toothbrush and the gap becomes smaller which allows the fingers 62 to be inserted into the holes and pass through the smaller opening. After insertion, the head of the fingers 62 recovers because of the resilient properties of the thermoplastic materials and the fingers 62 securely lock the insert into the surface 72 of the toothbrush. The locking fingers 62 provide pressurized fit along the contact surface 69 between the locking fingers 62 and the toothbrush's respective holes. Other means for securing the clear window insert to the toothbrush handle can be implemented that are consistent with the product described in this patent.

Figure 20:
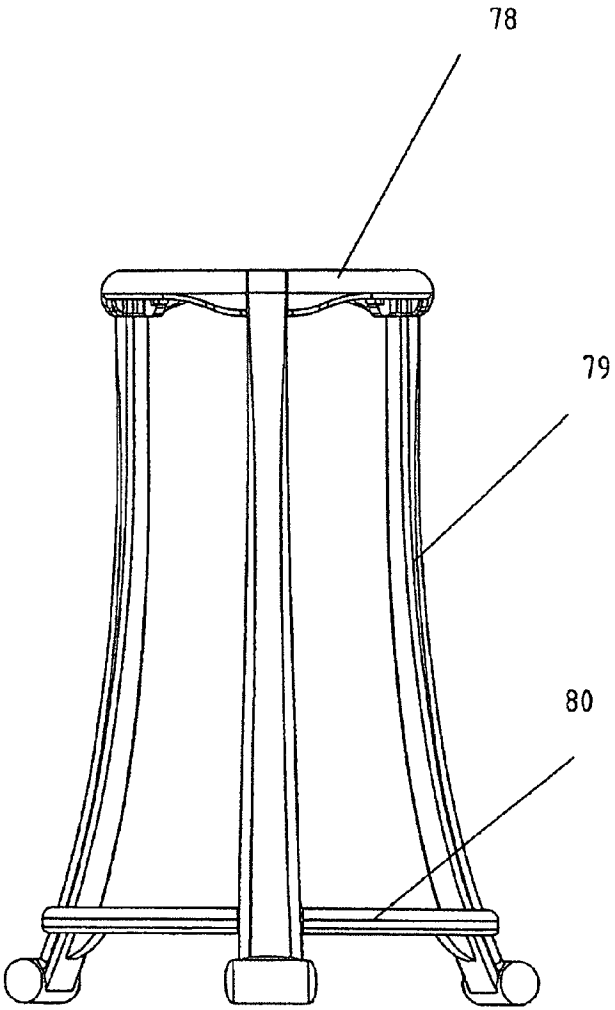
FIG. 20 is a side view of the present toothbrush holder configured to hold three toothbrushes.
Figure 19:
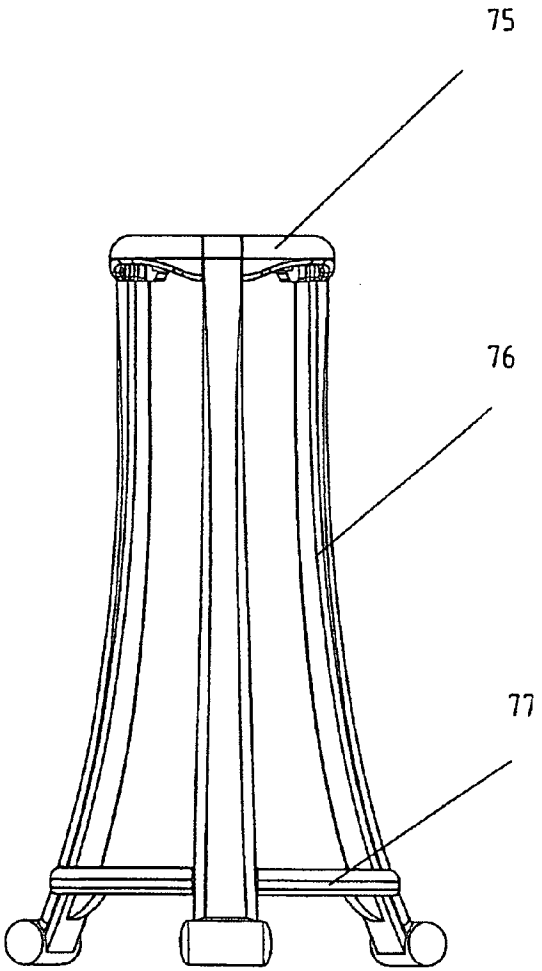
FIG. 19 is a side view of the present toothbrush holder configured to hold one toothbrush.

The toothbrush holder for the toothbrushes can be configured to hold one brush, as shown in FIG. 19. The toothbrush holder has a support ring 75, support legs 76, and a support base 77. This toothbrush holder with independent components allows for production of a multicolor product and provides flat packaging for convenience of handling and saving shelf space in the stores. The toothbrush holder can also be configured to hold more than one brush, one example of this is three brush holder illustrated in FIG. 20. Multi-brush toothbrush holders have a support ring and a support base for a specific number of brushes. The three toothbrush holder in FIG. 20 has a support ring 78, support legs 79, and a support base 80.

Figure 21:
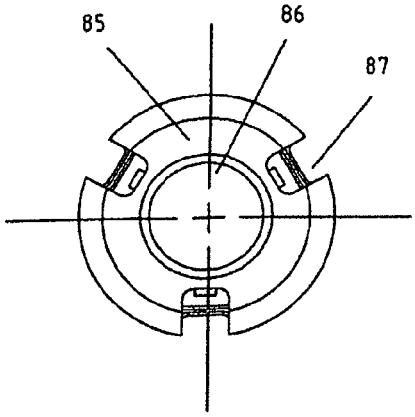
FIG. 21 is a top view of the toothbrush holder's handle support ring for one toothbrush.
Figure 22:
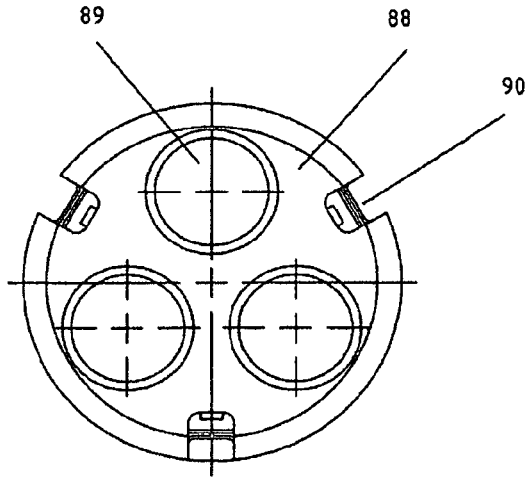
FIG. 22 is a top view of the toothbrush holder's handle support ring for three toothbrushes.
Figure 23:
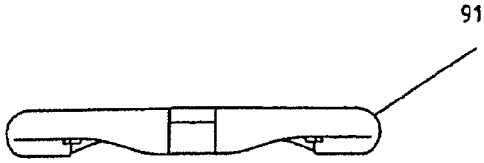
FIG. 23 is a side view of the toothbrush holder's handle support ring.
Figure 24:
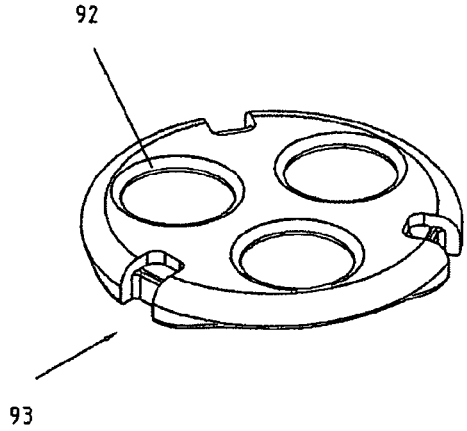
FIG. 24 is an axonometric view of the toothbrush holder's handle support ring for three toothbrushes.

FIGS. 21 and 22 show two possible configurations for the toothbrush holder support rings. In FIG. 21, toothbrush holder support ring 85 has one opening 86 to accommodate one brush. Three landing ground places 87 for the toothbrush holder are provided in the support ring 85 for integration with the support legs. In FIG. 22, toothbrush holder support ring 88 has three openings 89 to accommodate three brushes. The openings 89 are equidistance from the center of the support ring 88 and accommodate three toothbrushes. Three landing ground places 90 are provided in the support ring 88 for integration with the support legs. The landing ground places for toothbrush holders of different configurations have identical designs and dimensions. The support ring 91 in FIG. 23 is shown from the side. The support ring 92 for three toothbrushes is shown from a different angle in FIG. 24.

Figure 25:
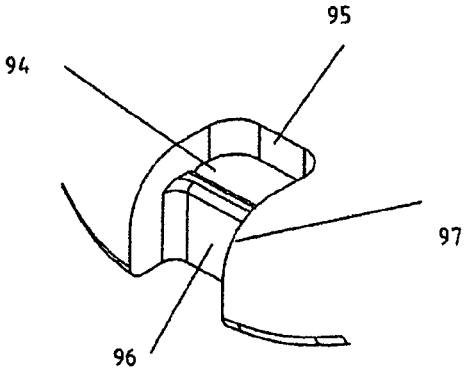
FIG. 25 is an enlarged fragmentary axonometric view of the locking element of the toothbrush holder's handle support ring.

The landing ground places in the support rings are constructed to hold the toothbrush holder support legs in place. The details of one embodiment of a landing ground place is shown in FIG. 25. Window 94 engages the support ring with the support leg. Walls 95 and 96 provide support to secure the support legs with support ring. The outside shape 97 of the support ring matches with the respective surface of the support legs without any gap, preventing accumulation of dirt and germs on the surface of the holder.

Figure 26:
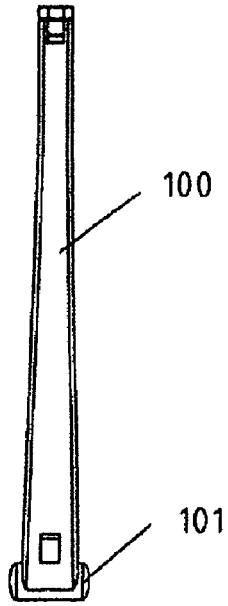
FIG. 26 is a front view of the universal support leg of the toothbrush holder.
Figure 27:
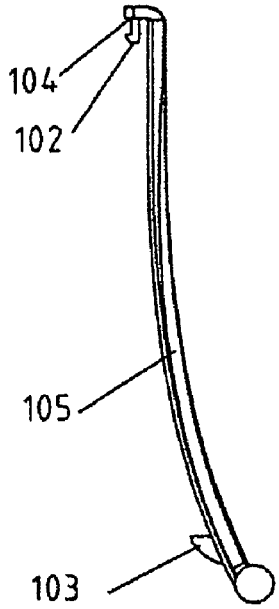
FIG. 27 is a side view of the universal support leg of the toothbrush holder.

The support legs are shown in FIGS. 26 and 27. Body 100 of the support leg terminates into support cylinder 101. Upper hook 102 and step 104 engage with respective surfaces 95 and 96 of the support ring 88 and secure the support ring 88 with support legs. The lower hook 103 provides placement of the support base 110 and secures support base 110 to the toothbrush holder.

Figure 28:
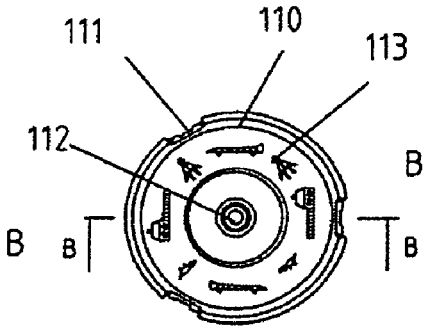
FIG. 28 is a top view of the base of the toothbrush holder for one toothbrush.

FIG. 28 is the top view of the support base 77 for a one item toothbrush holder. A notch 111 of the support base 77 engages with side surfaces 105 and lower hooks 103 of the support legs. The placement dimple or recess 112 properly locates the toothbrush tail in the holder and prevents the toothbrush from sliding along the surface of the toothbrush holder's base 77. A logo 113 can be placed around the dimple 112 on the flat surface 110 of the base 77.

Figure 29:
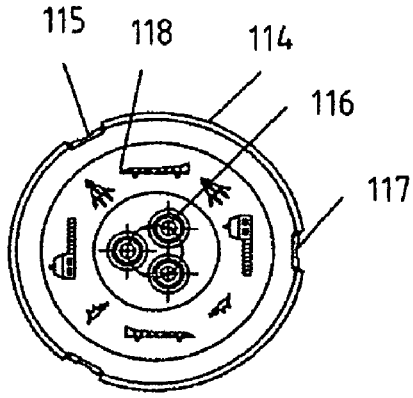
FIG. 29 is a top view of the base of the toothbrush holder for three toothbrushes.

FIG. 29 depicts the toothbrush holder's base 80 for a three item toothbrush holder. The notch 115 is the same as the notch 111. Three dimples 116 hold the toothbrush tails in place to prevent the toothbrush heads from touching while in the holder. The centers of the openings 89 for the toothbrushes on the support ring are farther from the center of the ring than the respective dimples 116 for the toothbrush tails located on the support base 80. After attaching the support ring to the three legs, the support base is pushed inside from the bottom of the assembled holder and securely placed on the lower hooks to lock the whole assembly.

Figure 30:
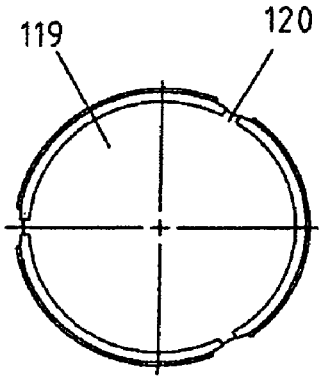
FIG. 30 is a bottom view of the toothbrush holder's base.
Figure 31:
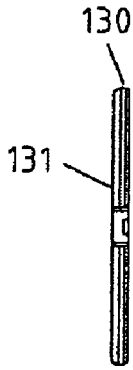
FIG. 31 is a side view of the toothbrush holder's base.

FIG. 30 is a bottom view of the holder's base without inserts. Bottom surface 119 is flat and has three notches 120 for securing the base to the lower hooks 103 of the legs 79. FIG. 31 is a side view of the toothbrush holder's base. Surface 131 is flat and the logo does not protrude above the surface of the base and side 130 of the base is rounded in this embodiment.

Figure 32:
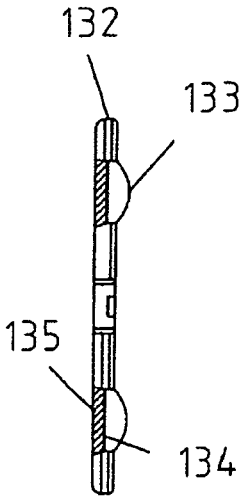
FIG. 32 is a side view of the toothbrush holder's base assembly with a convex window, image and plug.
Figure 33:
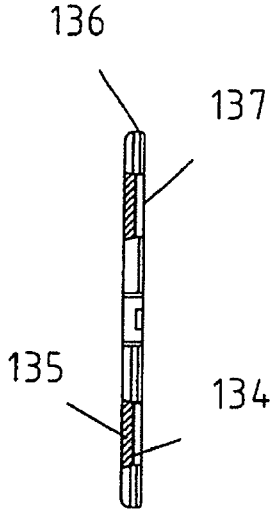
FIG. 33 is a side view of the toothbrush holder's base assembly with a flat window, image and plug.
Figure 34:
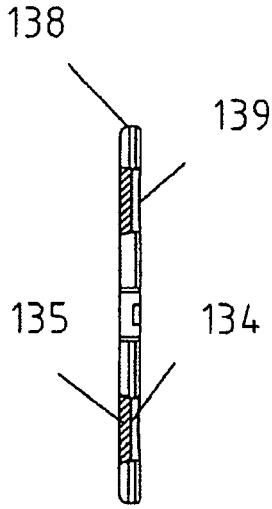
FIG. 34 is a side view of the toothbrush holder's base assembly with a concave window, image and plug.

The toothbrush holder base, much like the toothbrush handle, can be configured to display the insert in a variety of ways. For example, FIG. 32 shows a cross-section of the toothbrush holder base 132 with a convex window 133. The round insert 134 is secured by plug 135 behind the window 133 and shows through the convex window 133. In a different embodiment of the toothbrush holder base 136 shown in a cross sectional view in FIG. 33, the insert 134 is again secured by the plug 135, but the window 137 that allows the insert to be viewed in the toothbrush holder base 136 is flat. One other alternative, though the invention is not limited to the three configurations shown in the figures, incorporates a concave shape for the window 139 that allows the insert 134 to be viewed in the toothbrush holder base 138. This embodiment, shown in FIG. 34, illustrates a cross-section of the toothbrush holder base 138, showing how the insert 134 is secured by the plug 135 much like the other embodiments, but that a concave window 139 can be implemented as well.

Figure 35:
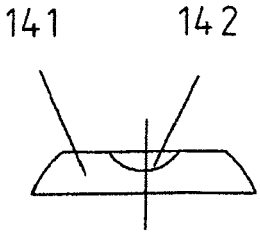
FIG. 35 is a cross-section along line B-B showing the recess in the base for the location of the toothbrush's tail.

The toothbrush holder is designed to not only be aesthetically pleasing, but to prevent some accumulation of germs on and around the toothbrushes. One aspect of the invention that services this purpose is the locator area (or locator areas, depending on how many toothbrushes the toothbrush holder is designed to hold) found in the base of the toothbrush holder. FIG. 35 shows locator area 142 for the tail of the toothbrush handle inserted in the toothbrush holder and placed on the base 141. This locator area 142 is a dimple or other structure that holds the tail of the toothbrush in place while it rests in the holder. The locator 141 helps to prevent the toothbrushes from touching one another while resting in the toothbrush holder by providing a distinct location in the toothbrush holder base 141 for the tail of the toothbrush to rest.

Figure 36:
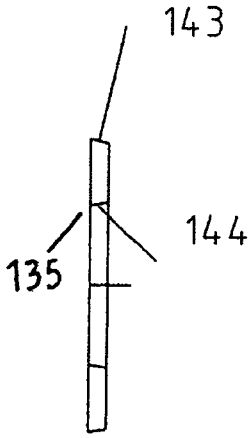
FIG. 36 is a side view of the plug.
Figure 37:
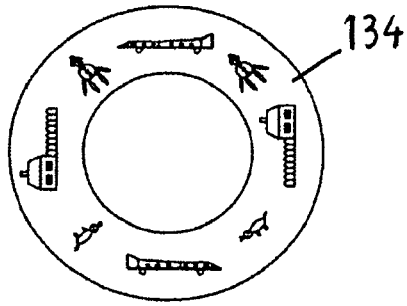
FIG. 37 is a view of the picture insert.

The plug and insert incorporated into the different embodiments of the toothbrush holder are shown in greater detail in FIGS. 36 and 37. In this embodiment, the plug 135 is designed with two tapered areas 143 and 144 that are designed to cooperatively engage the toothbrush holder base, keeping the insert securely in place. FIG. 37 is a view of the insert 134 for the toothbrush holder base. The insert 134 can be used to display logos, messages, pictures, or other images to create the desired effect. The insert 134 seen here is shaped to cooperatively engage the toothbrush holder base, much like the inserts shown in the previously described embodiments of the toothbrush.

Figure 38:
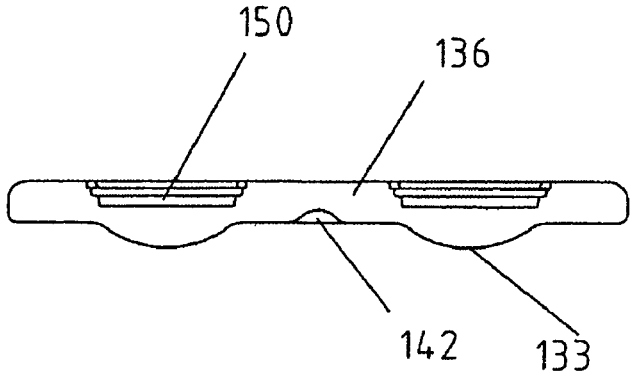
FIG. 38 is a cross-sectional view of the toothbrush holder's base.

FIG. 38 is a cross section of the toothbrush holder base 136 with a convex window area 133 and locator area 142. The insert 134 and the plug 135 are placed into the recess 150 to provide a protected display much like the embodiment shown in the toothbrush.

Figure 39:
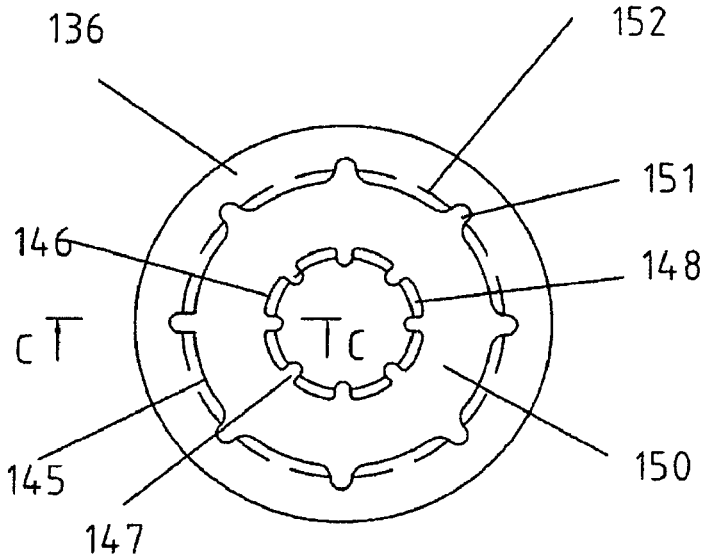
FIG. 39 is a bottom view of the toothbrush holder's base.

A different aspect of the toothbrush holder is shown in FIG. 39, showing the bottom view of the toothbrush holder's base 136. Recess 150 for the insert and plug has several slots 147 and 151 and undercut groove 152 in this embodiment. Slots 147 and 151 are made to allow molding the undercut groove 152 without distortion. The slots 147 and 151 also facilitate assembly. This aspect of the toothbrush holder is assembled by putting the insert, which is a predetermined shape that cooperatively engages the recess, into the recess. Next, plug 135 is pushed inside the base 136 into the recess 150. The plug 135 flexes the outside walls 145 and 146 of the recess 150, slipping into the grooves 148 and 152. This embodiment secures the insert 134 inside the base 136, but the invention is not limited to this embodiment, other ways of physically securing the insert 134 inside the base 136 can be used as well.

Figure 40:
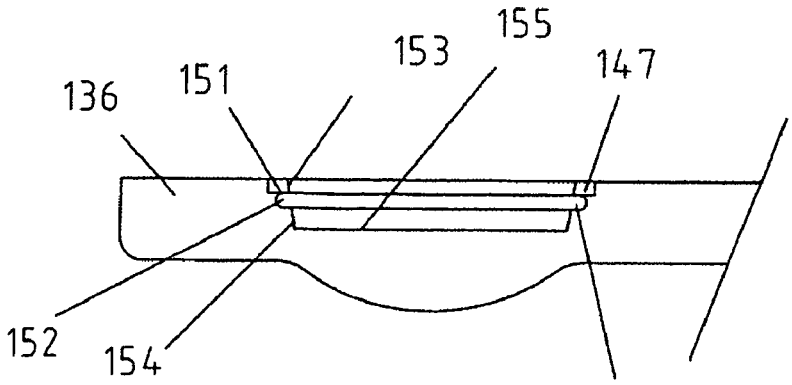
FIG. 40 is an enlarged view of a cross section of the toothbrush holder's base.

The implementation of the invention in the toothbrush holder's base 135 is shown in greater detail in FIG. 40, the cross-sectional view C-C of the toothbrush holder's base 135. The bottom part of the base 136 has recess 150 (FIG. 39) for the insert 134 (FIG. 37) and plug 135 with technological slots 147 and 151, grooves 152 and 148 tapered pocket 154 with bottom 155. Picture 134 is placed on the bottom 155 during assembly operation and facing concave area 133 (FIG. 38). The bottom of the recess 155 can be flat, concave or convex in shape. In embodiments where the bottom recess shape is not flat, the picture insert and corresponding surface of the plug insert are shaped to cooperatively engage the shape of the recess surface 155.

Figure 41:
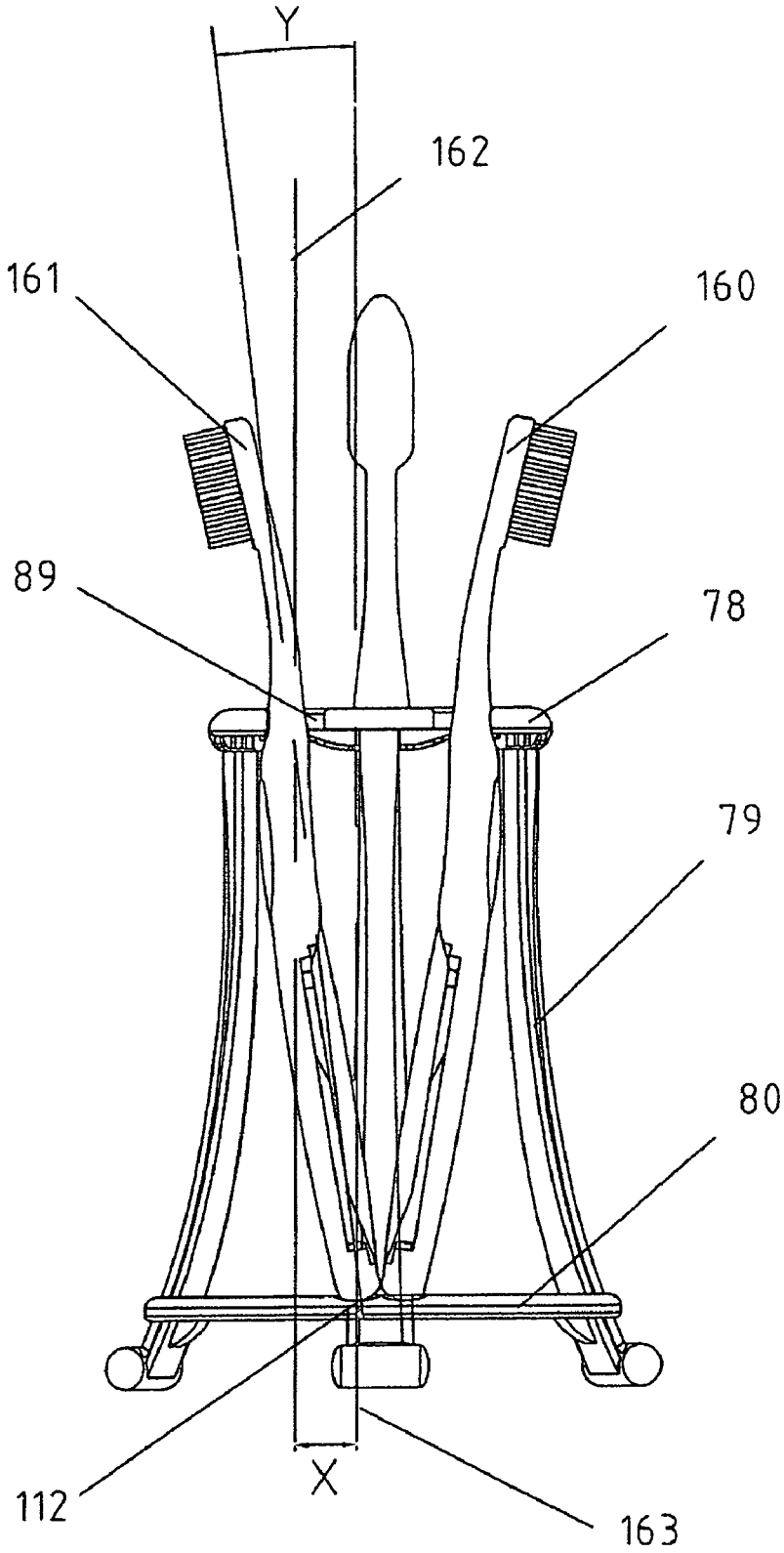
FIG. 41 is a side view of the toothbrushes in the toothbrush holder configured to hold three toothbrushes, partially broken away.

FIG. 41 is a view of the toothbrush holder 89 with toothbrushes 160 and 161 inserted in place. This illustrates a combination of the different aspects of the invention for an aesthetically pleasing effect. The toothbrushes 160 and 161 are pictured with inserts facing opposite the toothbrush 160 and 161 bristles. The colors of the toothbrushes 160 and 161 and toothbrush holder 89, as well as the images and/or text chosen for display, can be coordinated if desired.

This embodiment of the toothbrush holder 89 with supporting ring 78, legs 79 and base 80 has locators 112 on the holder's base 80 for correct placement of the toothbrush tails on the base 80. These locators are dimples or other means of providing support for the toothbrush tail placed on the holder's base 80 at some distance from the longitudinal axis 163 of the holder 89. Support ring 78 has openings for placement of the toothbrushes 160 and 161 into the holder 89. These openings are also located on some distance 162 from the longitudinal axis 163 of the holder. The corresponding centers of the locators 112 and openings in the support ring 78 are a distance X, as indicated in the drawing, from each other. Locators 112 on the base 80 are closer to the longitudinal axis 163 of the holder 89 and support ring 78 openings are farther from the longitudinal axis 163 of the holder 89. The placement of the locators 112 and openings in the support ring 78 creates an angle Y, as indicated in the drawing, for the toothbrush 160 and 161 placement. The angle Y of toothbrush 160 and 161 placement allows toothbrushes 160 and 161 to stay in the holder 89 without touching other toothbrush bristles. The separate storage for toothbrushes 160 and 161, combined with the ease with which the toothbrush holder 89 may be cleaned prevents some accumulation of germs in the toothbrush holder 89 and some passing of germs from one toothbrush 160 to another 161.

Figure 42:
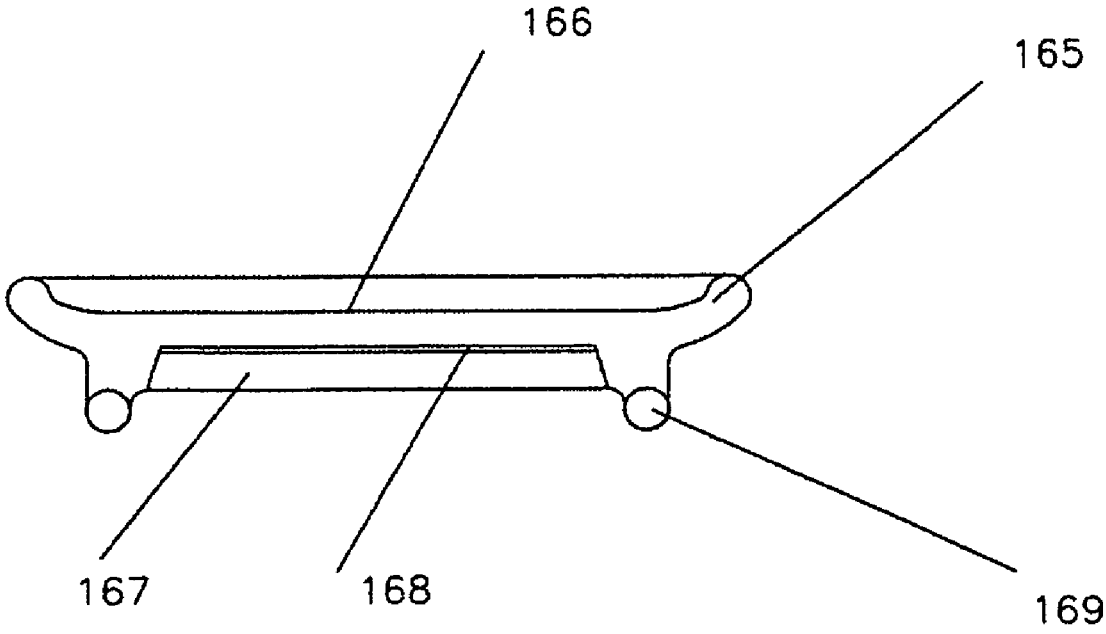
FIG. 42 is a cross-sectional view of an embodiment of the present soap dish according to the principles of the invention.

The principles of this invention can also be applied to other toiletry articles. For example, FIG. 42 is a side view of an embodiment of a soap dish containing an insert with a visual display. The soap dish has a base 169 that supports the soap dish on a surface such as a washbasin countertop. The soap dish has a concave peripheral region 165 that is used to contain a bar of soap or other items. An inner surface 166 supports the soap. The soap dish has an insert 168 located below the inner surface 166, the inner surface being transparent or translucent so that the picture or text information can be seen from the top surface. Lower support 167 is used to hold the insert 168 in place. The inserts, plugs, windows, and other components and constructions of the toothbrush and toothbrush holder may be utilized to provide plugs, inserts, images, logos, and the like in the present soap dish.

Figure 43:
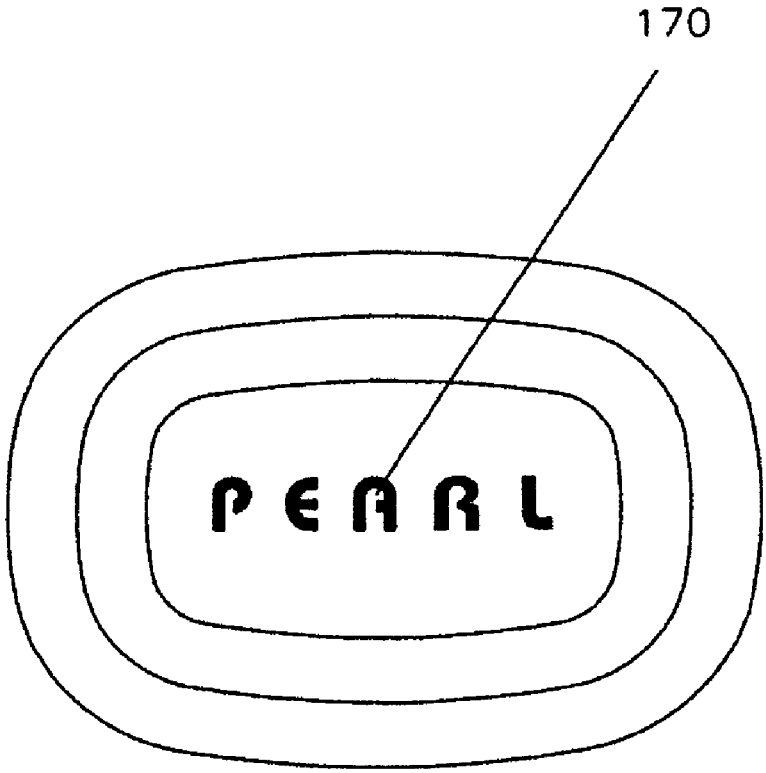
FIG. 43 is a top view of the embodiment of the soap dish shown in FIG. 42.

FIG. 43 displays one embodiment of the soap dish, in a top plan view, with the insert 170 showing through the transparent inner surface. The insert 170 is protected from wear and from repeated contact with soap by the inner surface of the soap dish, providing a image that will remain clear throughout extended use of the soap dish. The soap dish can be coordinated with the various embodiments of the toothbrush and toothbrush holder pictured in the other figures to provide a coordinated and aesthetically pleasing suite of toiletry articles.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art. The particular implementations shown and described herein are illustrative examples of the invention and are not intended to otherwise limit the scope of the invention in any way.

For the sake of brevity, conventional aspects (and components) may not be described in detail. Furthermore, the connecting lines, or connectors shown in various figures presented are intended to represent exemplary functional relationships and/or physical or logical couplings between the various elements. It should be noted that many alternative or additional functional relationships, physical connections or logical connections may be present in a practical device. Numerous modifications and adaptations will be readily apparent to those skilled in this art without departing from the spirit and scope of the present invention.

I claim:

1. A toiletry article comprising:

a toiletry article body;

the body of the toiletry article having a recess;

the recess having a pre-determined shape with sides and a bottom;

a display insert with an integral visual display; and the display insert having a predetermined shape for cooperative engagement in the recess;

wherein the toiletry article is a toothbrush, the toothbrush comprising:

a head portion;

bristles attached to one side of the head portion;

a handle portion connected to the head portion;

the handle portion and head portion formed of a thermoplastic material;

the display insert with the integral visual display where the display is on at least one side of the display insert;

a window insert inside the recess on the display insert with the integral visual display; and an elastomeric material on the handle;

a plurality of interchangeable display inserts with the integral visual display having differing text or images and of a predetermined shape for cooperative engagement in the recess, wherein the visual display on the display insert is surrounded by an elastomeric material.

2. The toiletry article according to claim 1, wherein the elastomeric material is a thermoplastic elastomer.

3. The toiletry article according to claim 1, wherein the handle and the head are formed of a clear thermoplastic material.

4. The toiletry article according to claim 1, wherein the handle and the head are formed of an opaque thermoplastic material.

5. The toiletry article according to claim 1, further comprising the visual display of the display insert having at least one of the following text; and an image.

6. The toiletry article according to claim 1, further comprising the display insert having a latching mechanism of a predetermined shape for locking the display insert to the recess.

7. The toiletry article according to claim 6, wherein the latching mechanism further comprises a resilient portion attached to the window insert; and an opening defined by the handle of a predetermined shape to cooperatively engage the resilient portion of the window insert.

8. The toiletry article according to claim 1, wherein the handle part further comprises a first portion on the same side of the handle part as the bristles;

a second portion on the opposite side of the handle part as the bristles;

a grip formed of elastomeric material;

a portion of the grip formed on the first portion of the handle; and a portion of the grip formed on the second portion of the handle.

9. The toiletry article according to claim 1, wherein the handle portion is clear and the visual display in the display insert is a picture.

10. The toiletry article according to claim 1, wherein the display insert further comprises:

a perimeter having a predetermined shape smaller than the predetermined shape of the recess;

at least one rib having a substantially pyramid shape located on the perimeter of the display insert;

the at least one rib having a height sufficient to form a gap between the perimeter of the display insert and the walls of the pocket; and a first part of the display insert;

a second part of the display insert; and the first part having a greater diameter than the second part.

11. The toiletry article according to claim 1, wherein the handle portion is clear and the display insert is on the opposite side of the bristles.

12. The toiletry article according to claim 1, wherein the handle portion is clear and the display insert is on the same side as the bristles.

13. The toiletry article according to claim 1, wherein the handle portion is opaque and the display insert is placed on the opposite side of the bristles.

14. The toiletry article according to claim 1, wherein the handle portion is opaque and the display insert is on the same side as the bristles.

15. The toiletry article according to claim 1, wherein the handle portion is opaque and the display insert is on any side of the toothbrush.

16. The toiletry article according to claim 1, wherein the window insert is flat.

17. The toiletry article according to claim 1, wherein the window insert is concave.

18. The toiletry article according to claim 1, wherein the window insert is convex.

19. A toiletry article comprising:

a toiletry article body;

the body of the toiletry article having a recess;
the recess having a pre-determined shape with sides and a bottom;
display insert with an integral visual display; and
the display insert having a predetermined shape for cooperative engagement in the recess;
wherein the toiletry article is a toothbrush comprising:
a head portion;
bristles attached to one side of the head portion;
a handle portion connected to the head portion;
the handle portion and head portion formed of a thermoplastic material;
the display insert with the integral visual display where the display is on at least one side of the insert;
a window insert inside the recess on the display insert with the integral visual display; and
an elastomeric material on the handle;
wherein the display insert further comprises:
a perimeter having a predetermined shape smaller than the predetermined shape of the recess;
at least one rib having a substantially pyramid shape located on the perimeter of the display insert;
the at least one rib having a height sufficient to form a gap between the perimeter of the display insert and the walls of the pocket; and
a first part of the display insert;
a second part of the display insert; and
the first part having a greater diameter than the second part.

20. The toiletry article according to claim 19, wherein the elastomeric material is a thermoplastic elastomer.

21. The toiletry article according to claim 19, wherein the handle and the head are formed of a clear thermoplastic material.

22. The toiletry article according to claim 19, wherein the handle and the head are formed of an opaque thermoplastic material.

23. The toiletry article according to claim 19, further comprising the visual display of the display insert having at least one of the following:
text; and
an image.

24. The toiletry article according to claim 19, further comprising a plurality of interchangeable display inserts with the integral visual display having differing text or images and of a predetermined shape for cooperative engagement in the recess.

25. The toiletry article according to claim 24, wherein the visual display on the display insert is surrounded by an elastomeric material.

26. The toiletry article according to claim 19, further comprising the display insert having a latching mechanism of a predetermined shape for locking the display insert to the recess.

27. The toiletry article according to claim 26, wherein the latching mechanism further comprises
a resilient portion attached to the window insert; and
an opening defined by the handle of a predetermined shape to cooperatively engage the resilient portion of the window insert.

28. The toiletry article according to claim 19, wherein the handle part further comprises
a first portion on the same side of the handle part as the bristles;
a second portion on the opposite side of the handle part as the bristles;
a grip formed of elastomeric material;
a portion of the grip formed on the first portion of the handle; and
a portion of the grip formed on the second portion of the handle.

29. The toiletry article according to claim 19, wherein the handle portion is clear and the visual display in the display insert is a picture.

30. The toiletry article according to claim 19, wherein the handle portion is clear and the display insert is on the opposite side of the bristles.

31. The toiletry article according to claim 19, wherein the handle portion is clear and the display insert is on the same side as the bristles.

32. The toiletry article according to claim 19, wherein the handle portion is opaque and the display insert is placed on the opposite side of the bristles.

33. The toiletry article according to claim 19, wherein the handle portion is opaque and the display insert is on the same side as the bristles.

34. The toiletry article according to claim 19, wherein the handle portion is opaque and the display insert is on any side of the toothbrush.

35. The toiletry article according to claim 19, wherein the window insert is flat.

36. The toiletry article according to claim 19, wherein the window insert is concave.

37. The toiletry article according to claim 19, wherein the window insert is convex.

38. A toiletry article comprising:
a toiletry article body;
the body of the toiletry article having a recess;
the recess having a pre-determined shape with sides and a bottom;
a display insert with an integral visual display; and
the display insert having a predetermined shape for cooperative engagement in the recess;
wherein the toiletry article is a toothbrush comprising:
a head portion;
bristles attached to one side of the head portion;
a handle portion connected to the head portion;
the handle portion and head portion formed of a thermoplastic material;
the display insert with the integral visual display where the display is on at least one side of the display insert;
a window insert inside the recess on the display insert with the integral visual display; and
an elastomeric material on the handle;
wherein the visual display on the display insert is surrounded by an elastomeric material.

* * * * *